US008292103B2

(12) United States Patent
Weist

(10) Patent No.: US 8,292,103 B2
(45) Date of Patent: Oct. 23, 2012

(54) CONTAINER CLOSURE

(75) Inventor: Mario Weist, Waidhofen an der (AT)

(73) Assignee: capArtis AG, Schaffhausen (CH)

( * ) Notice: Subject to any disclaimer, the term of this patent is extended or adjusted under 35 U.S.C. 154(b) by 1042 days.

(21) Appl. No.: 12/089,269

(22) PCT Filed: Oct. 28, 2005

(86) PCT No.: PCT/EP2005/055644

§ 371 (c)(1),
(2), (4) Date: Jul. 23, 2008

(87) PCT Pub. No.: WO2007/038991

PCT Pub. Date: Apr. 12, 2007

(65) Prior Publication Data

US 2008/0277371 A1 Nov. 13, 2008

(30) Foreign Application Priority Data

Oct. 6, 2005 (EP) ..... 05109275

(51) Int. Cl.
*B65D 41/34* (2006.01)
*B65D 51/16* (2006.01)
*B65D 47/32* (2006.01)

(52) U.S. Cl. ..... 215/252; 215/387; 220/203.28; 220/254.8; 220/259.3; 220/714; 222/525

(58) Field of Classification Search ..... 215/237, 215/243, 252, 387; 220/254.8, 259.1, 259.3, 220/714, 717, 203.23; 222/524, 525, 153.14
See application file for complete search history.

(56) References Cited

U.S. PATENT DOCUMENTS 5,328,063 A 7/1994 Beck et al.
5,810,185 A * 9/1998 Groesbeck ..... 215/387
(Continued)

FOREIGN PATENT DOCUMENTS

EP 1065150 1/2001
(Continued)

*Primary Examiner* — Anthony Stashick
*Assistant Examiner* — Niki Eloshway
(74) *Attorney, Agent, or Firm* — Fish & Associates, PC

(57) ABSTRACT

The container closure (1) includes a flange (2) having an inlet opening (2*p*) and an outlet tube (2*a*) having a thread (2*b*) arranged after the inlet opening (2*p*) in the outflow direction and includes a rotary closure (3) with an outlet opening (3*p*) and with a thread (3*i*), wherein the two threads (2*b*, 3*i*) engage into one another and are aligned such that the rotary closure (3) is rotatable with respect to the flange (2) about an axis of rotation (D) and is displaceably mounted in the direction of the rotary axis (D), wherein the flange (2) includes a sealing lip (2*i*) projecting towards the axis of rotation (D) which forms the inlet opening (2*p*) extending concentric to the axis of rotation (D), wherein the rotary closure (3) has a spigot (3*a*) arranged concentric to the axis of rotation (D) which is arranged in the outflow direction after the inlet opening (2*p*) and wherein the spigot (3*a*) and the sealing lip (2*i*) are designed mutually matched so that the spigot (3*a*) which can be displaced in the direction of the axis of rotation (D) can adopt at least two positions, a closed position (SS) in which the spigot (3*a*) contacts the sealing lip (2*i*) so that the inlet opening (2*p*) is closed and an open position (OS), in which the spigot (3*a*) is spaced from the sealing lip (2*i*) so that the inlet opening (2*p*) is opened.

26 Claims, 17 Drawing Sheets

U.S. PATENT DOCUMENTS

Figures 1, 1A:
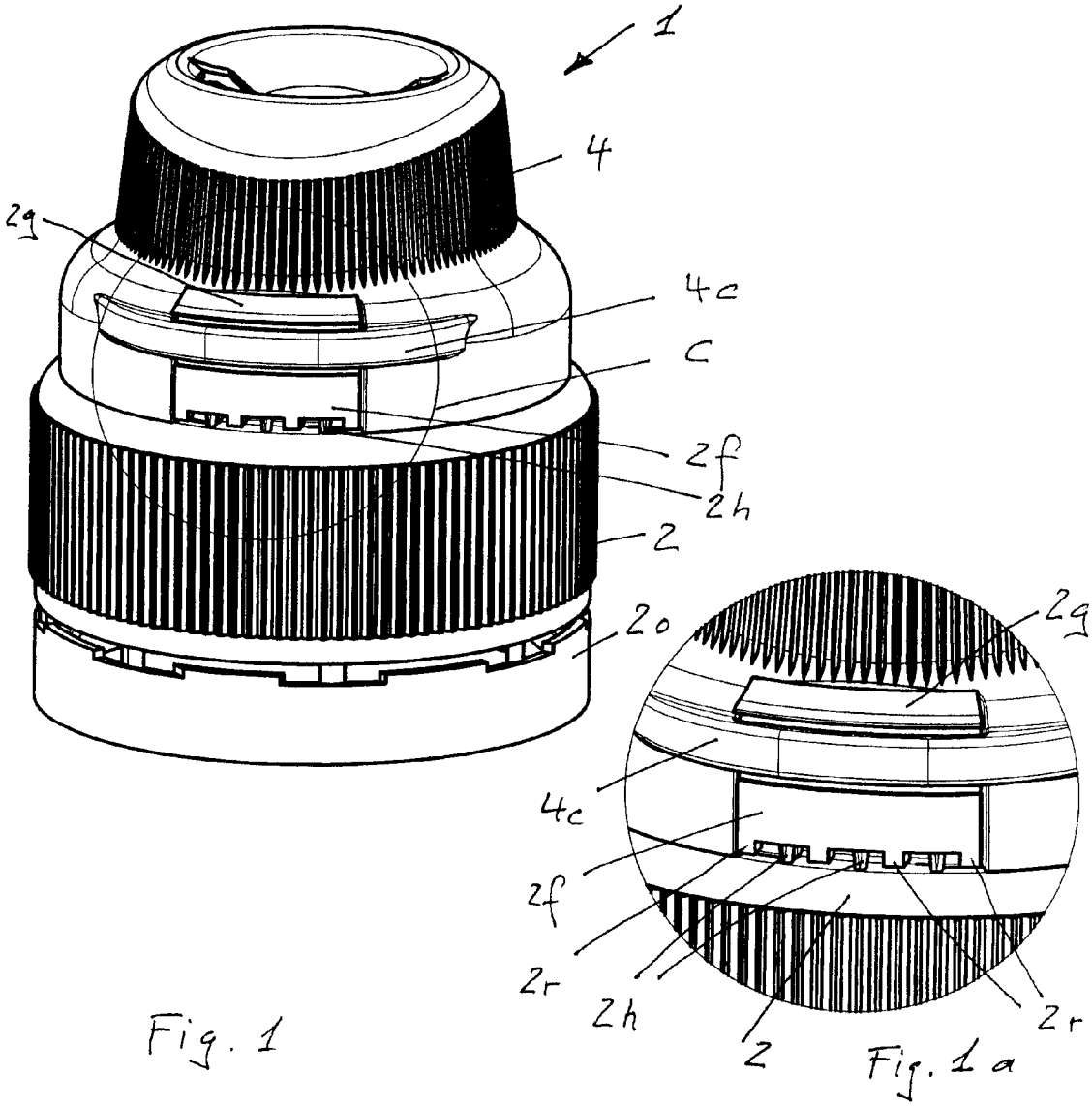

| | | | | |
|---|---|---|---|---|
| 5,975,369 | A * | 11/1999 | Yurkewicz et al. | 222/153.06 |
| 6,213,351 | B1 | 4/2001 | Stoneberg et al. | |
| 6,338,425 | B1 * | 1/2002 | Berge et al. | 222/521 |
| 6,477,743 | B1 * | 11/2002 | Gross et al. | 222/525 |
| 7,043,911 | B2 * | 5/2006 | Arrigoni et al. | 60/578 |
| 7,988,004 | B1 * | 8/2011 | Marret et al. | 215/252 |
| 2003/0230546 | A1 * | 12/2003 | Yurkewicz et al. | 215/251 |
| 2004/0251276 | A1 * | 12/2004 | Adams et al. | 222/153.14 |
| 2007/0205229 | A1 * | 9/2007 | Schmeisser et al. | 222/525 |
| 2008/0041809 | A1 * | 2/2008 | Shek | 215/315 |
| 2009/0212061 | A1 * | 8/2009 | Naesje | 220/714 |

FOREIGN PATENT DOCUMENTS

| | | |
|---|---|---|
| WO | 2004/009455 | 1/2004 |
| WO | 2005/035379 | 4/2005 |

* cited by examiner

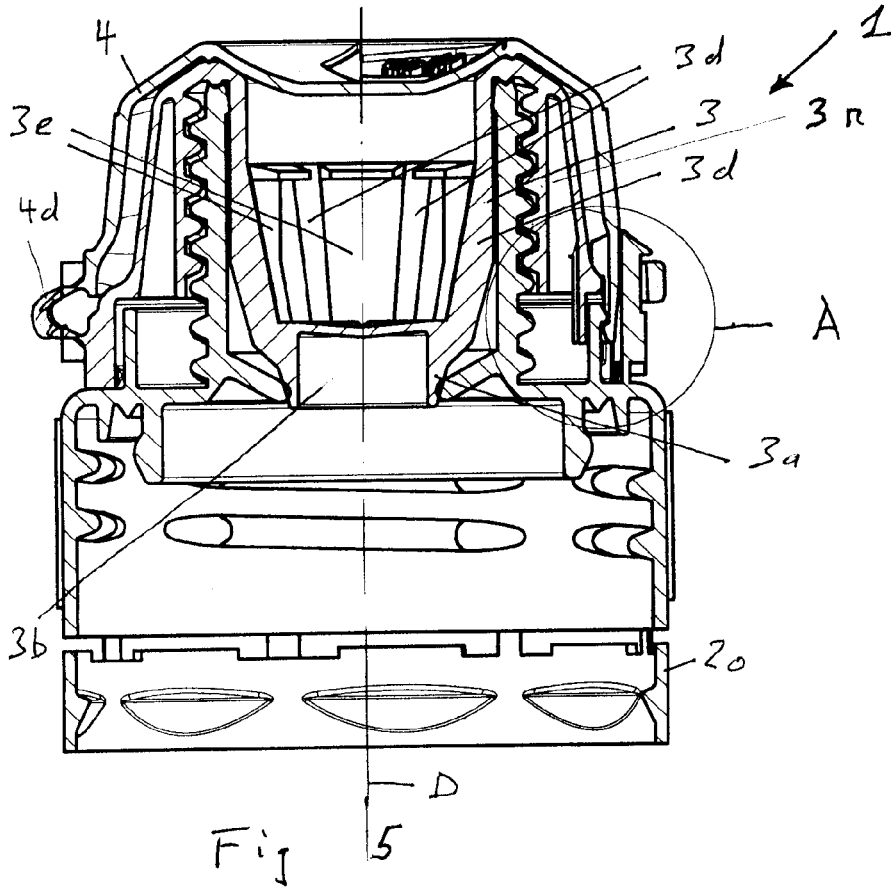
Fig
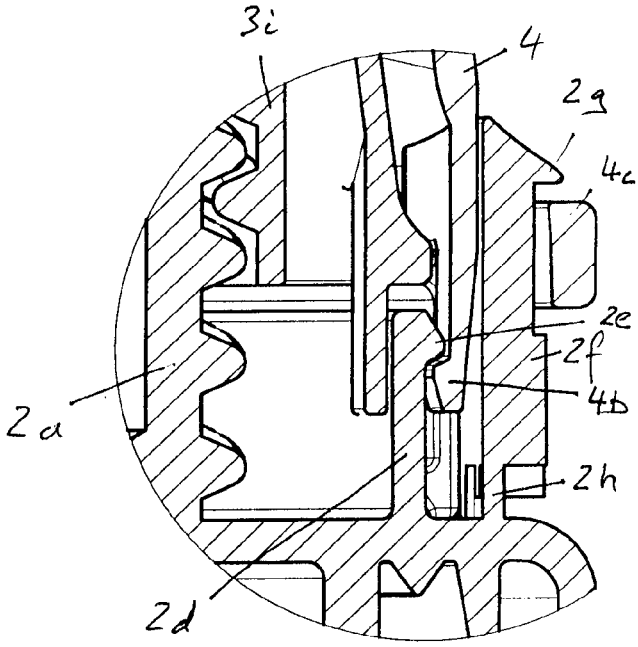
Fig. 6

CONTAINER CLOSURE

The invention relates to a container closure in accordance with the preamble of claim 1.

Containers, such as for example bottles, are normally provided with a container closure so that the bottle can be opened in a simple manner and can be closed again. The container closure preferably has a cap which can be attached to the container opening. Container closures, such as these are as a rule used for drinking bottles in the sports field, can be actuated by hand and ensure, in the closed position, a liquid-tight closure of the container content. If required, the container closure can be brought into an open position, so that the liquid which is present in the container can be removed without having to remove the container closure.

The document WO 2005/035379 discloses a container closure for drinking bottles which is also suitable for drinks containing carbon dioxide. This container closure has the disadvantage that it is complicated to operate. The container closure has the further disadvantages that it is difficult to reduce excess pressure, that a liquid containing carbon dioxide under pressure can shoot upwardly through the container closure and that the container closure cannot be kept hygienically clean.

It is the object of the present invention to improve a container closure of this kind such that it enables simple and reliable opening and re-closure and is operator-friendly to use.

This object is satisfied by a container closure having the features of claim 1. The subordinate claims 2 to 25 relate to further advantageous container closures.

The object is in particular satisfied with a container closure including a flange having an inlet opening and an outlet tube having a thread arranged after the inlet opening in the outflow direction and also including a rotary closure with an outlet opening and with a thread, wherein the two threads engage into one another and are aligned such that the rotary closure is rotatable with respect to the flange about an axis of rotation and is displaceably mounted in the direction of the rotary axis, wherein the flange includes a sealing lip projecting towards the axis of rotation which forms the inlet opening extending concentric to the axis of rotation and wherein the rotary closure has a spigot arranged concentric to the axis of rotation which is arranged in the outflow direction after the inlet opening and wherein the spigot and the sealing lip are designed mutually matched so that the spigot which can be displaced in the direction of the axis of rotation can adopt at least two positions, a closed position in which the spigot contacts the sealing lip so that the inlet opening is closed and an open position, in which the spigot is spaced from the sealing lip so that the inlet opening is opened.

The container closure in accordance with the invention has the advantage that it enables a reliable liquid-tight closure of a container content, in particular when a liquid containing carbon dioxide under pressure or a liquid which tends to gassing is present in the container. The container closure in accordance with the invention includes a rotary closure which is turned with respect to the flange about an axis of rotation. Independently of the speed of rotation of the rotary closure a person can himself determine how quickly the spigot is to be lifted and thereby the container closure is to be advantageously opened. A rapid opening of the container closure can be achieved, in dependence on the filling medium, in that the thread is formed with a large pitch so that a small amount of turning already produces a large stroke movement. The spigot can in particular also be very carefully lifted by correspondingly slow turning of the rotary closure. Moreover, the turning can be interrupted at any time so that the container closure can remain in any desired position. A person can thus himself determine the preferred opening and thus also the outflow speed which he regards as very pleasant. The container closure in accordance with the invention can moreover be closed again with the expenditure of little force. In a preferred embodiment, the container closure has an abutment so that the maximum stroke movement is restricted which for example ensures that the rotary closure is not separated from the flange.

In an advantageous embodiment the spigot is elastically mounted in the container closure so that the container closure opens automatically to dissipate pressure with a pressure which is too high in a container.

In a further advantageous embodiment the container closure has an outlet opening which has elements arranged distributed over its entire cross-sectional opening which cover the outlet opening so that a liquid which is emerging is deflected in the container closure and can thus not emerge as a direct jet.

In a preferred embodiment the container closure moreover has a protective cover which covers the rotary closure, at least at times, in order to keep the rotary closure and the outlet opening clean.

The container closure in accordance with the invention is suitable for a multitude of differently design containers or containers of different materials. The container can for example consist of glass, plastic, metal, card-board, of a cardboard composite or of a composite packing. The flange can be designed as a screwed cap which, for example, can be screwed onto the opening of a glass bottle. The flange can for example also be designed as a welded flange or as an adhesively bonded flange which can be secured to a packing material.

Figure 2:
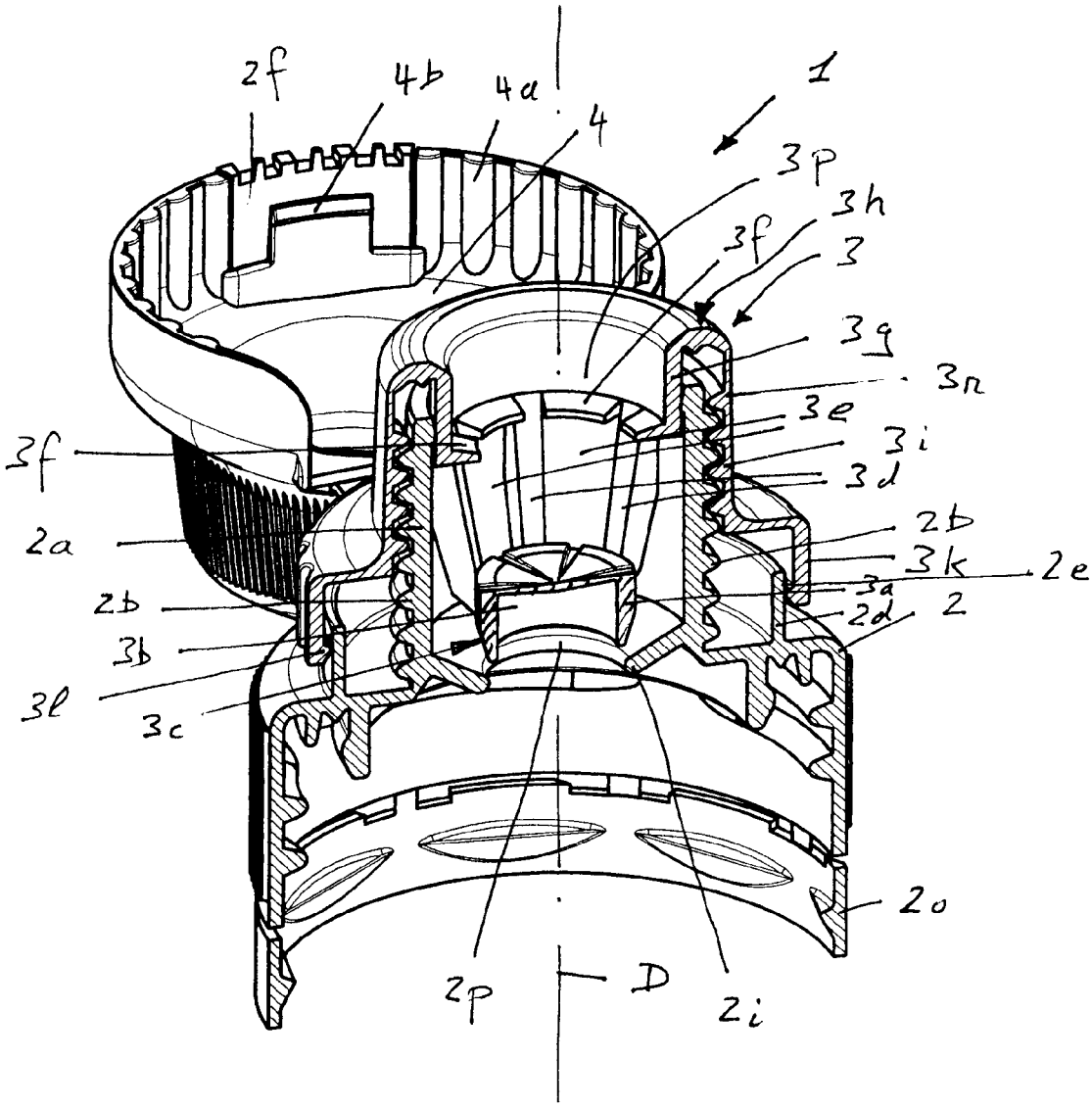
Figure 3:
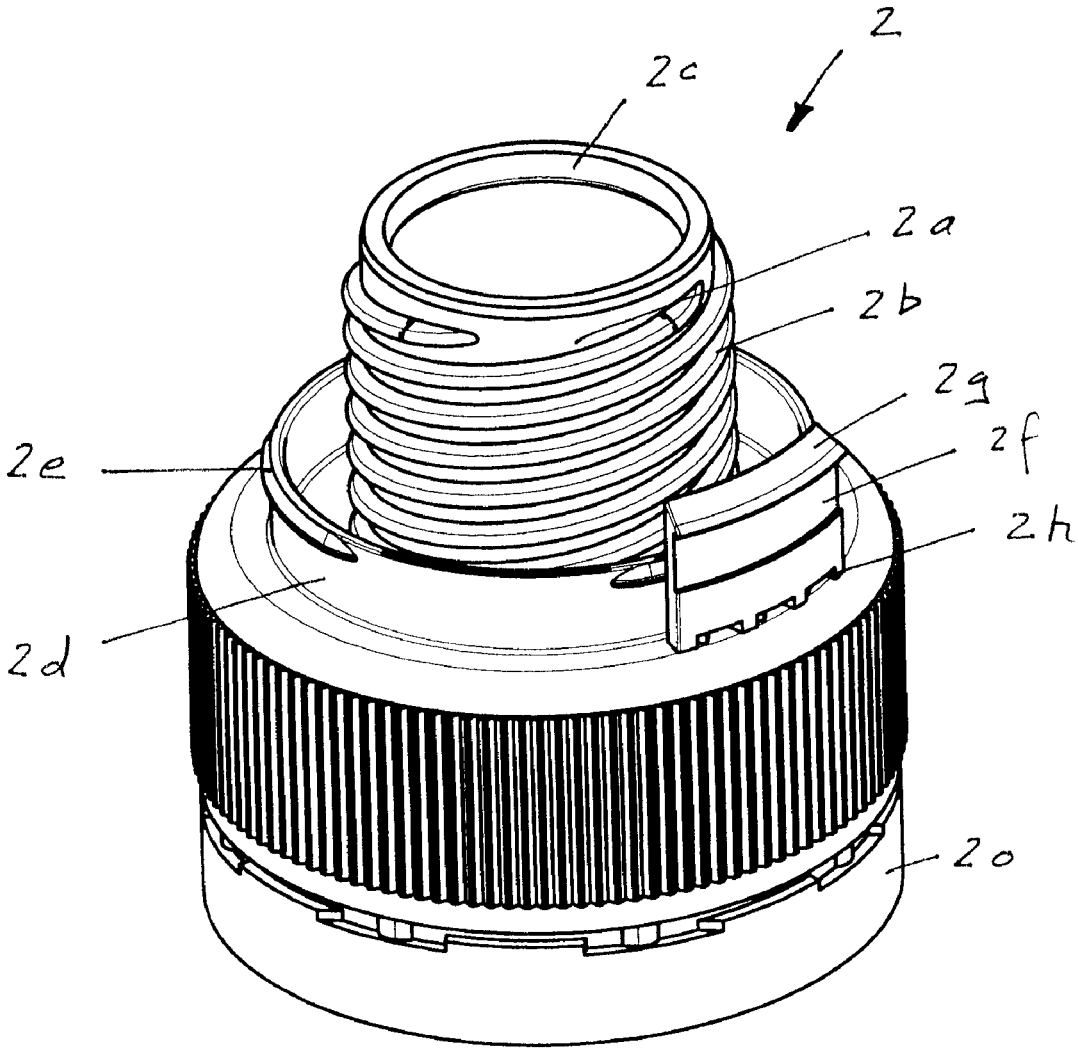
Figure 4:
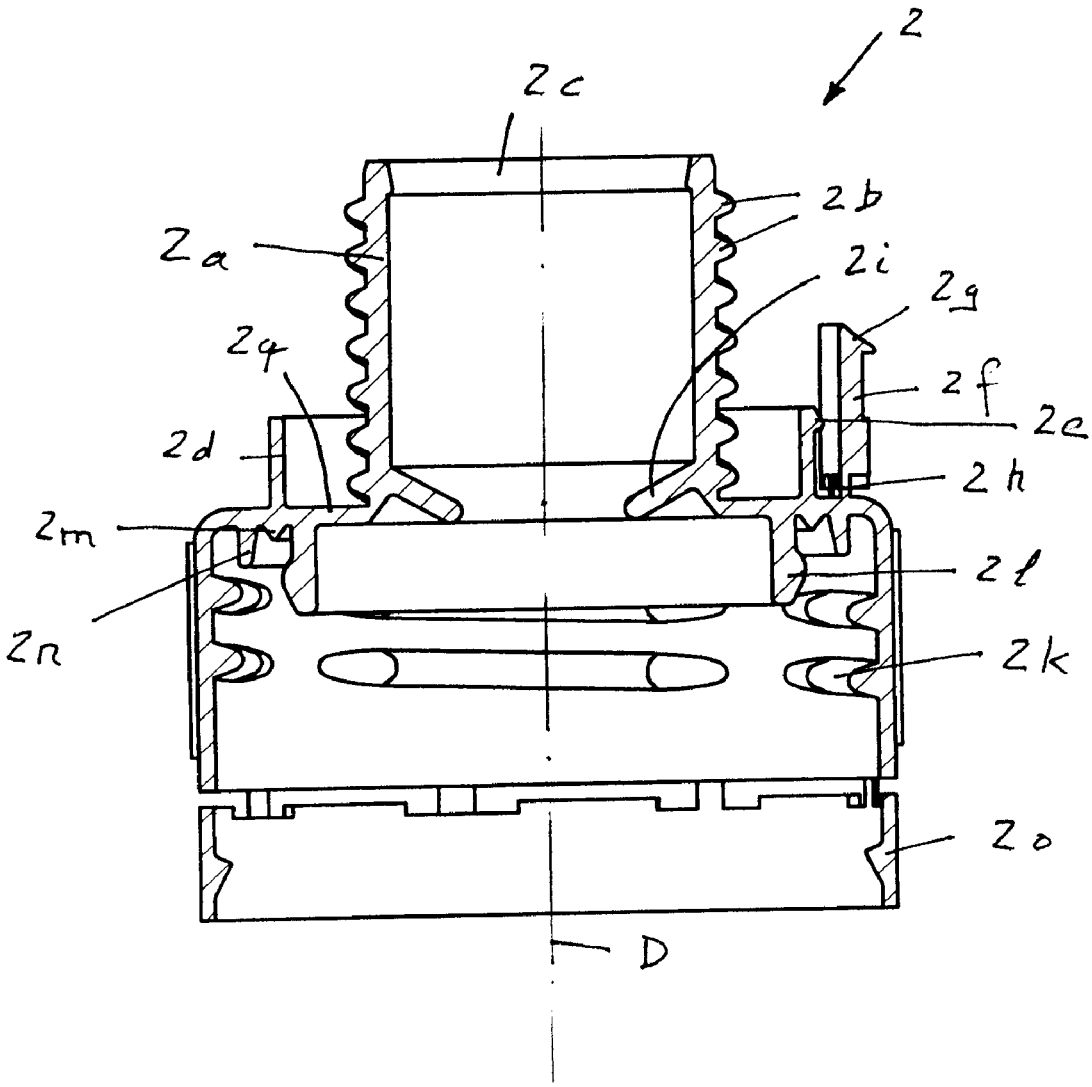
Figure 7:
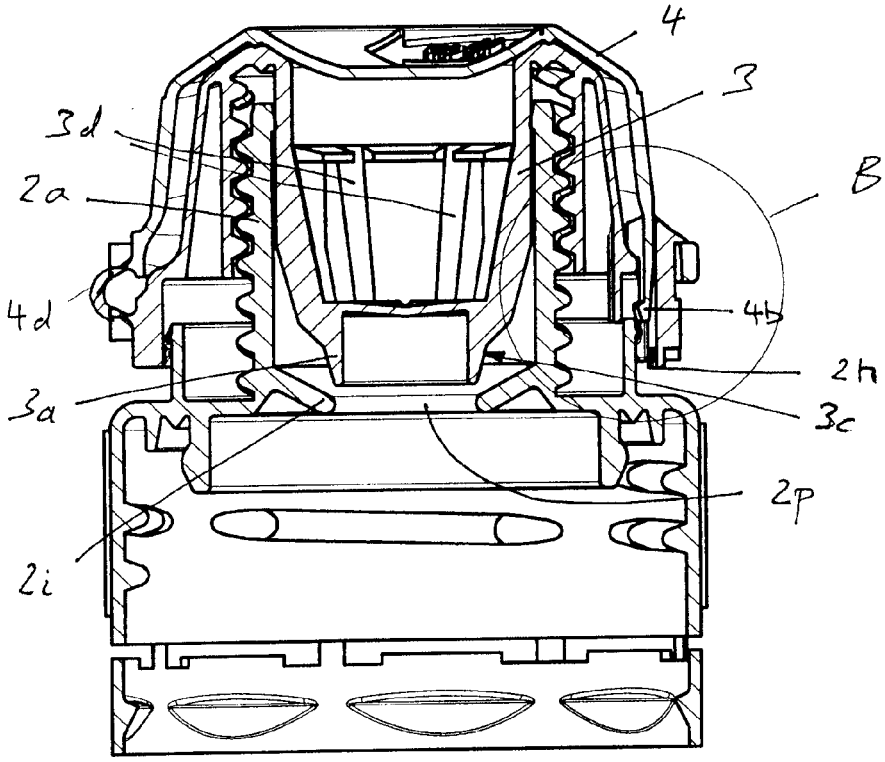
Figure 8:
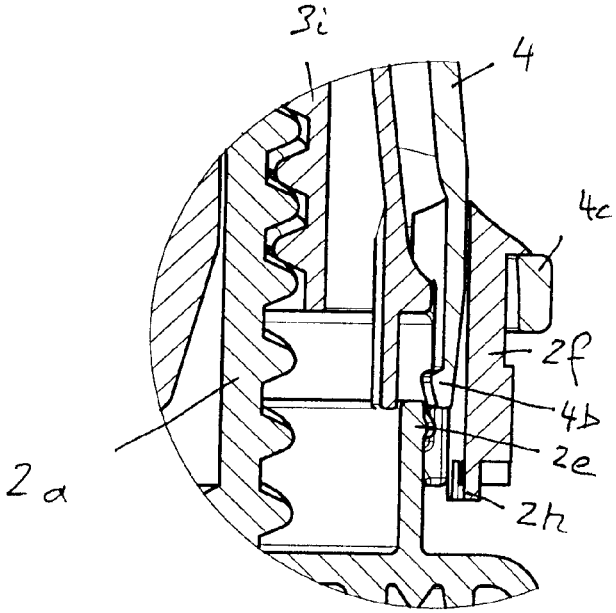
Figure 9:
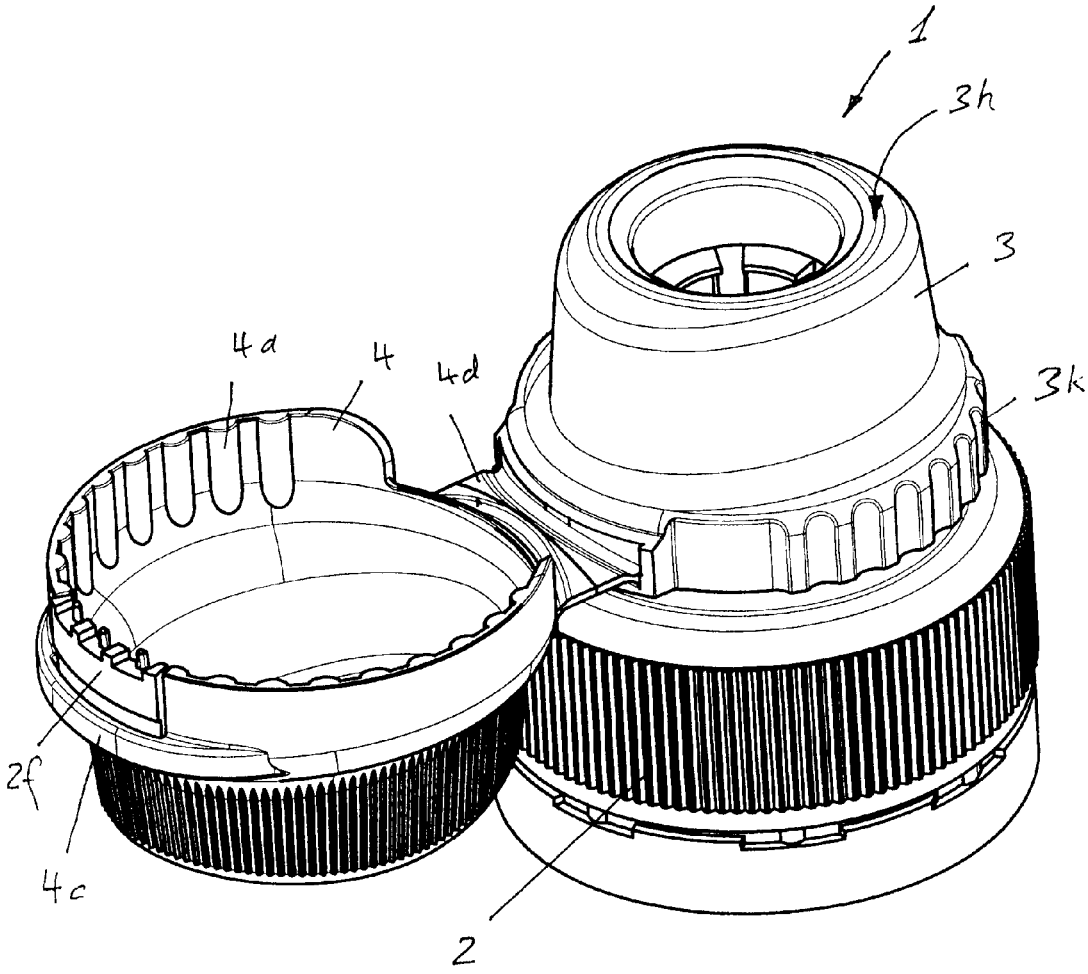
Figure 10:
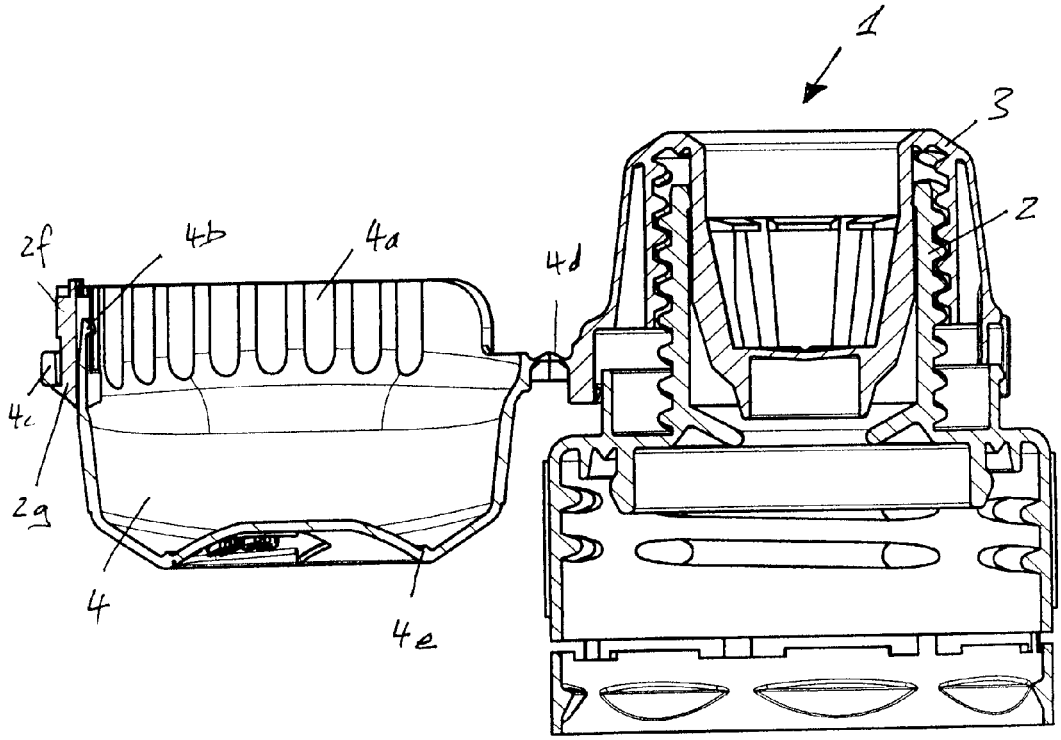
Figure 11:
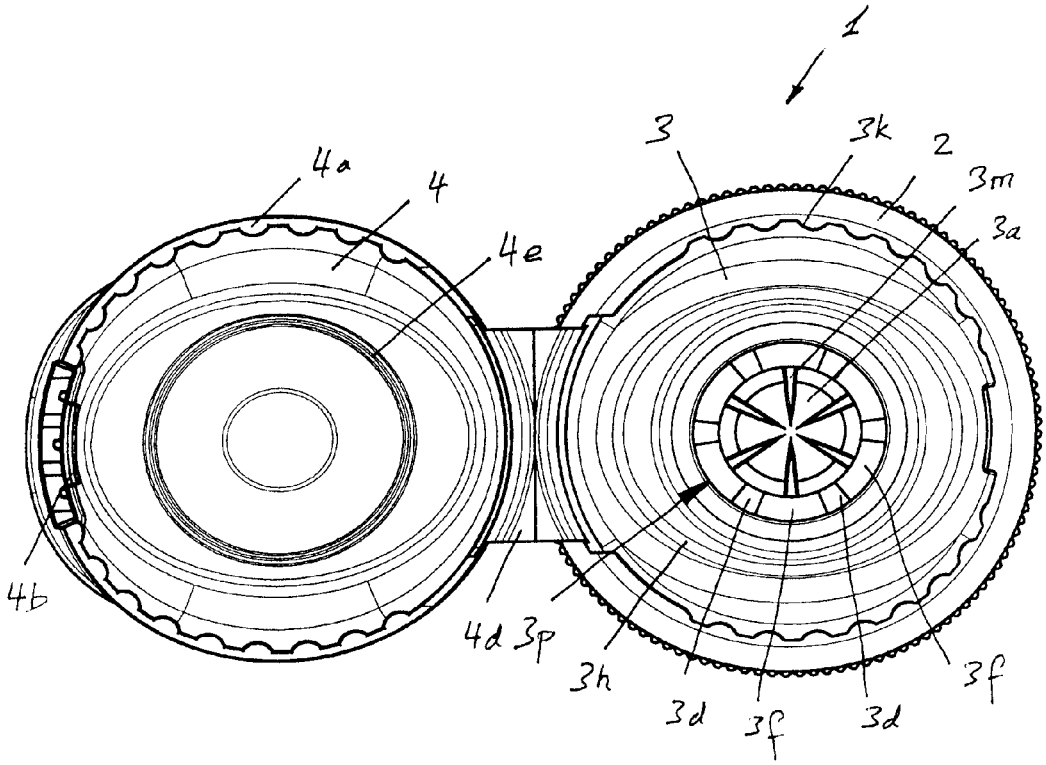
Figure 12:
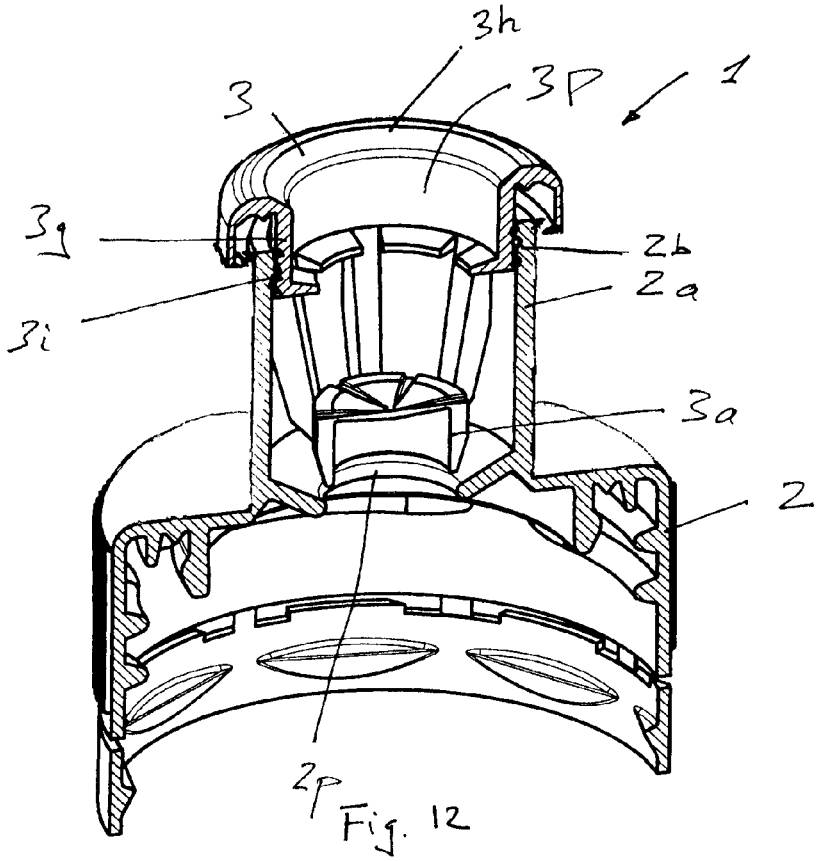
Figure 13:
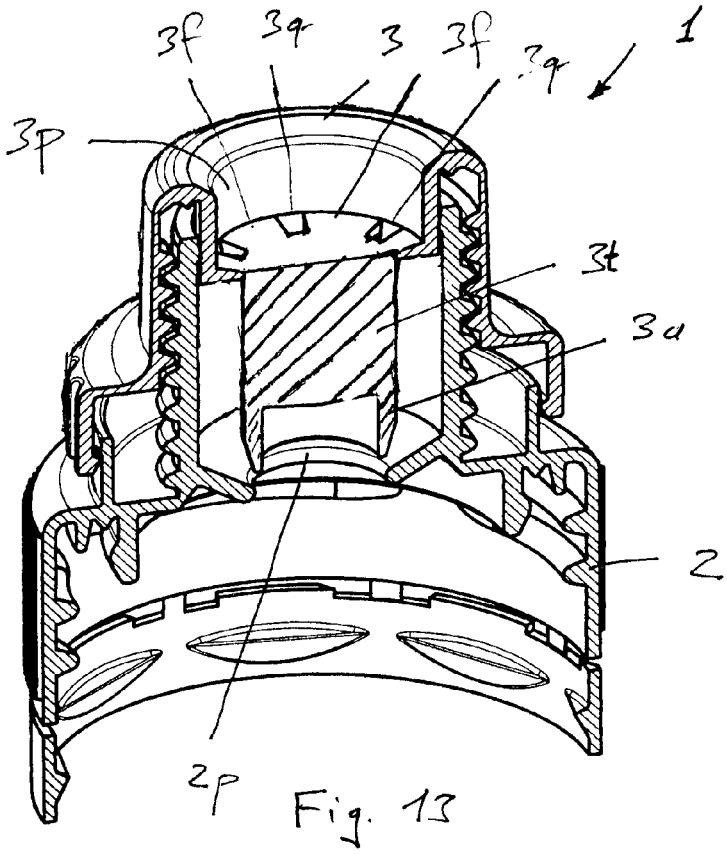
Figure 14:
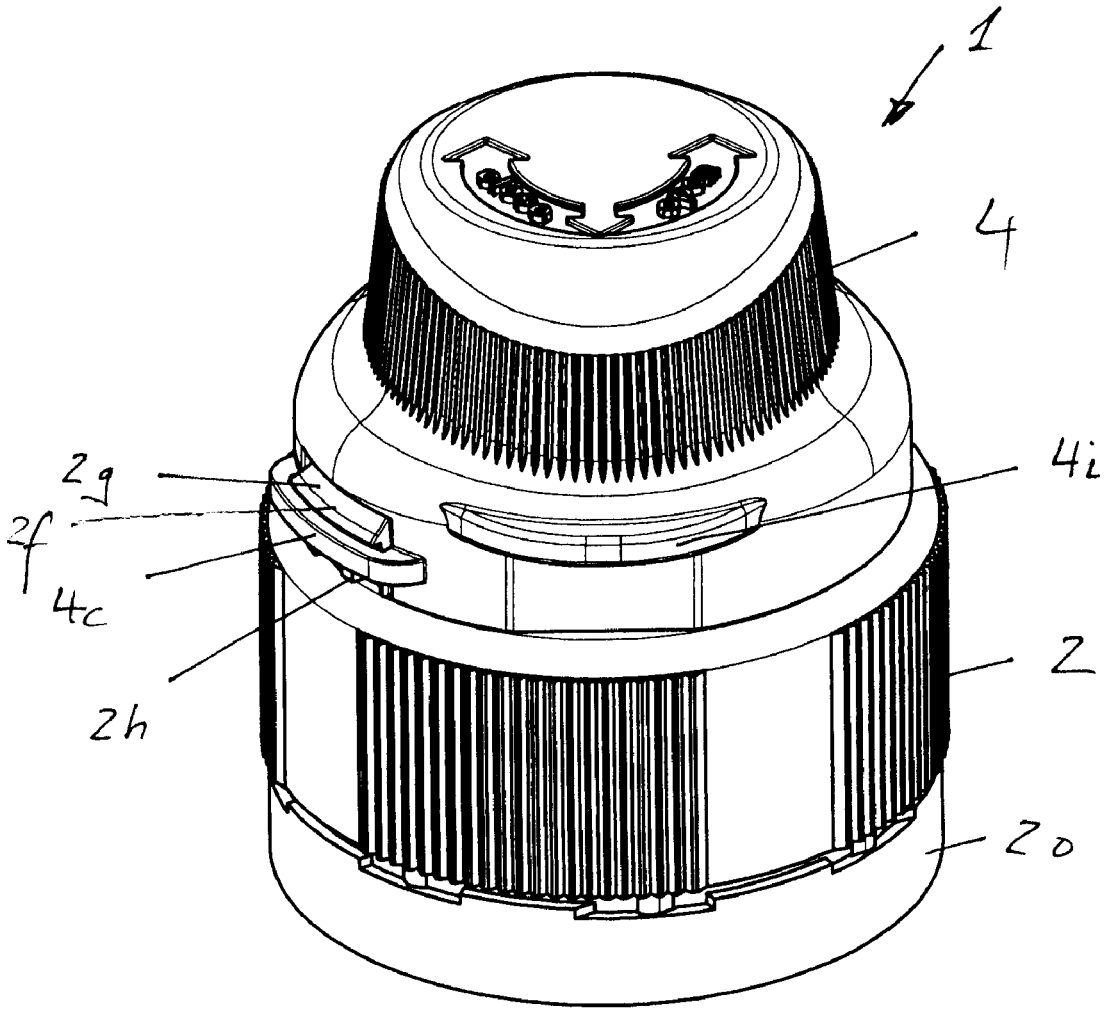
Figure 15:
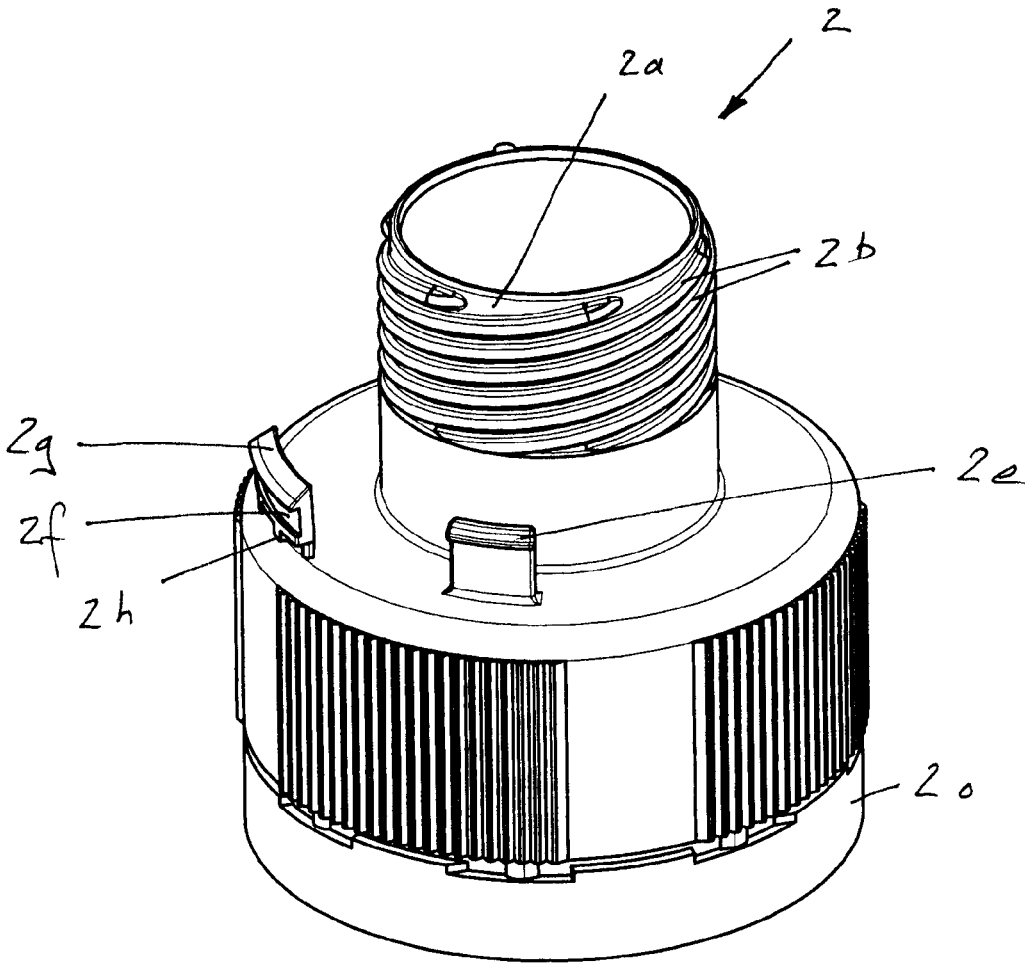
Figure 16:
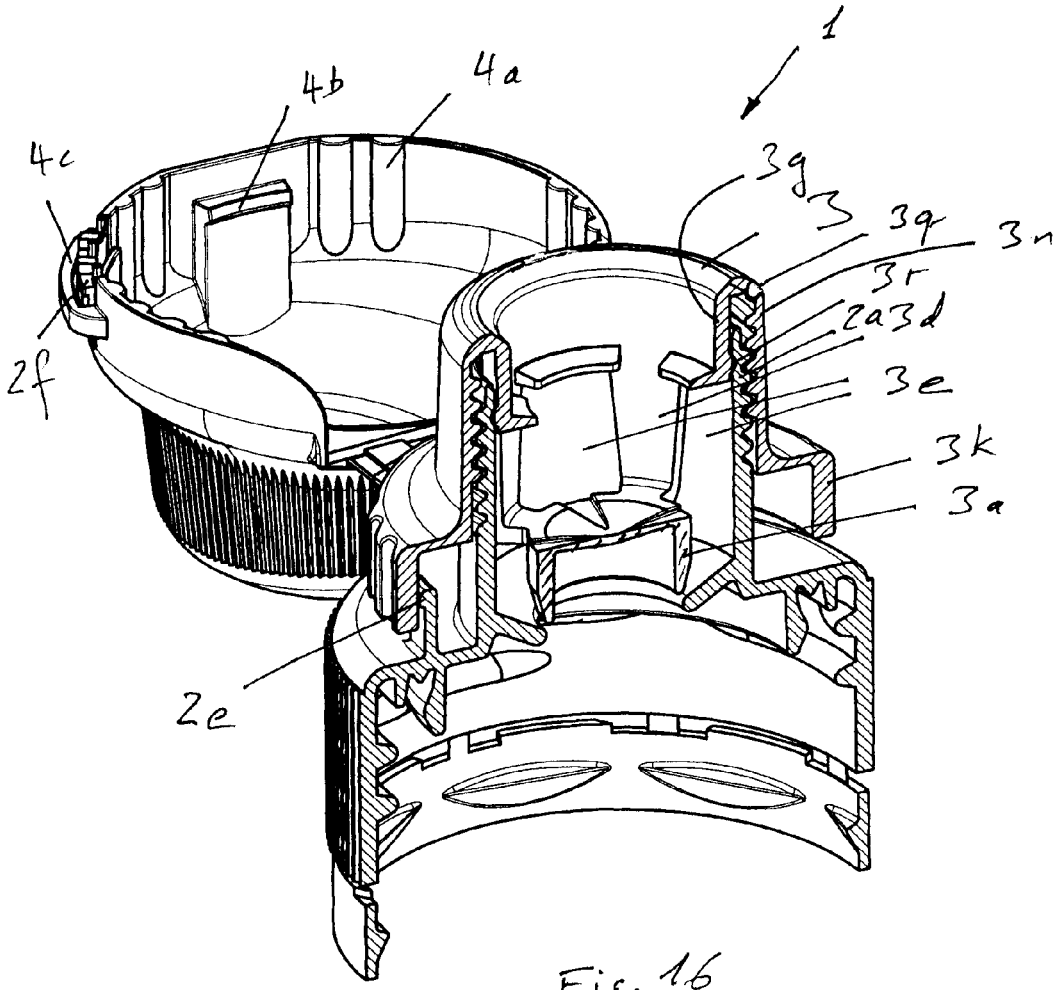
Figure 17:
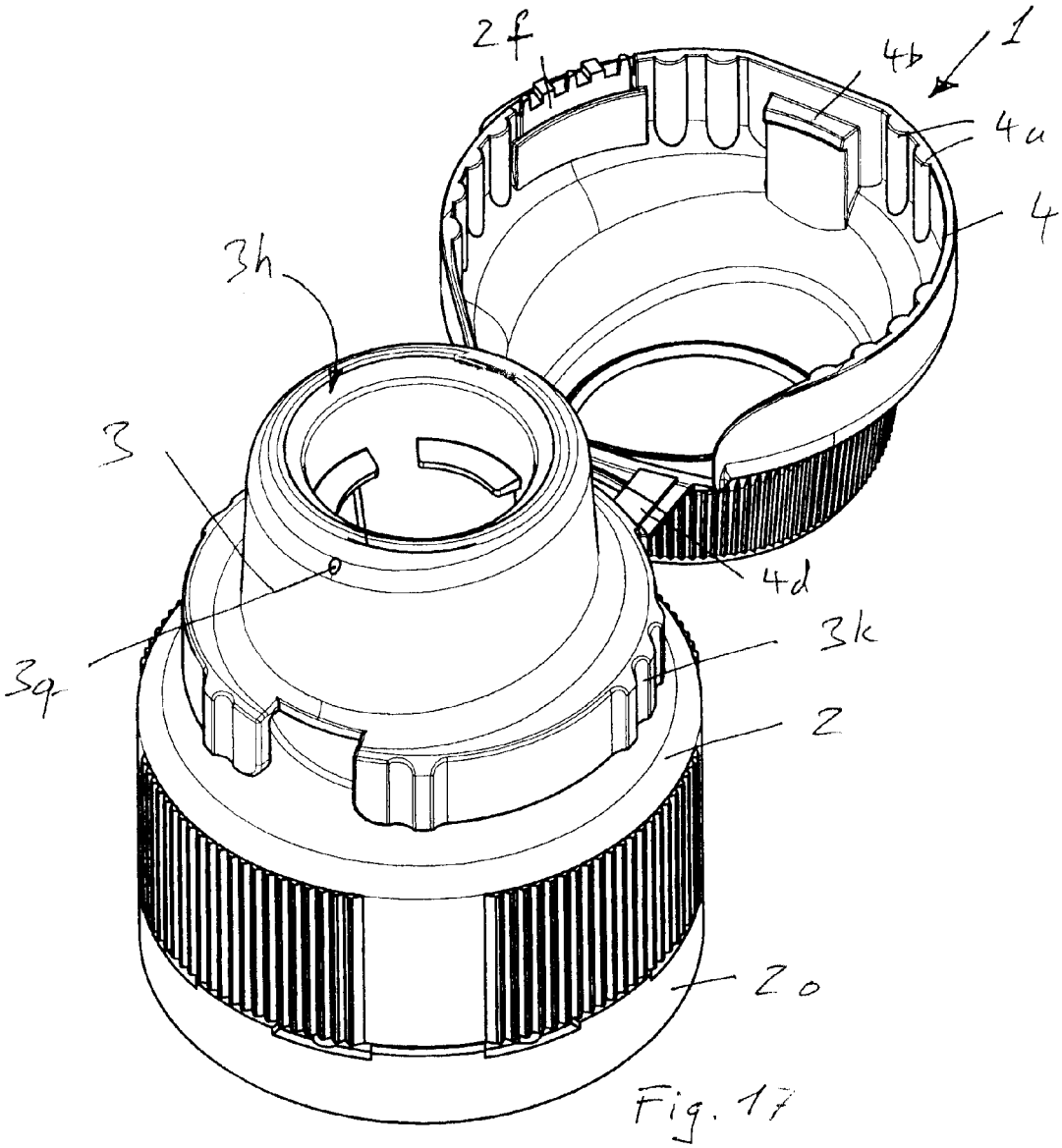
Figure 18:
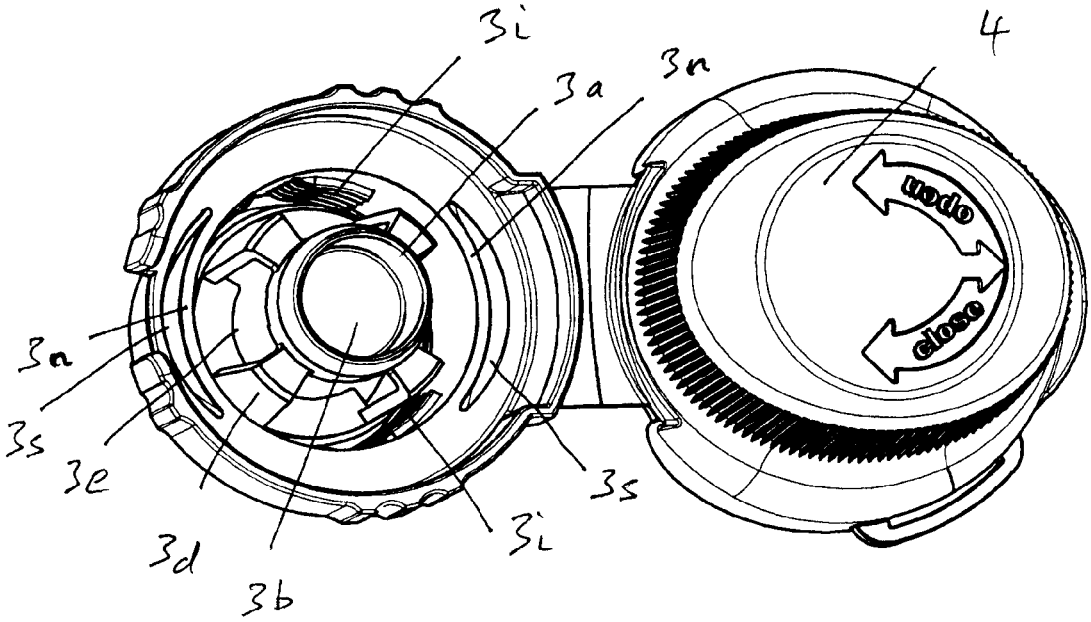
Figure 19:
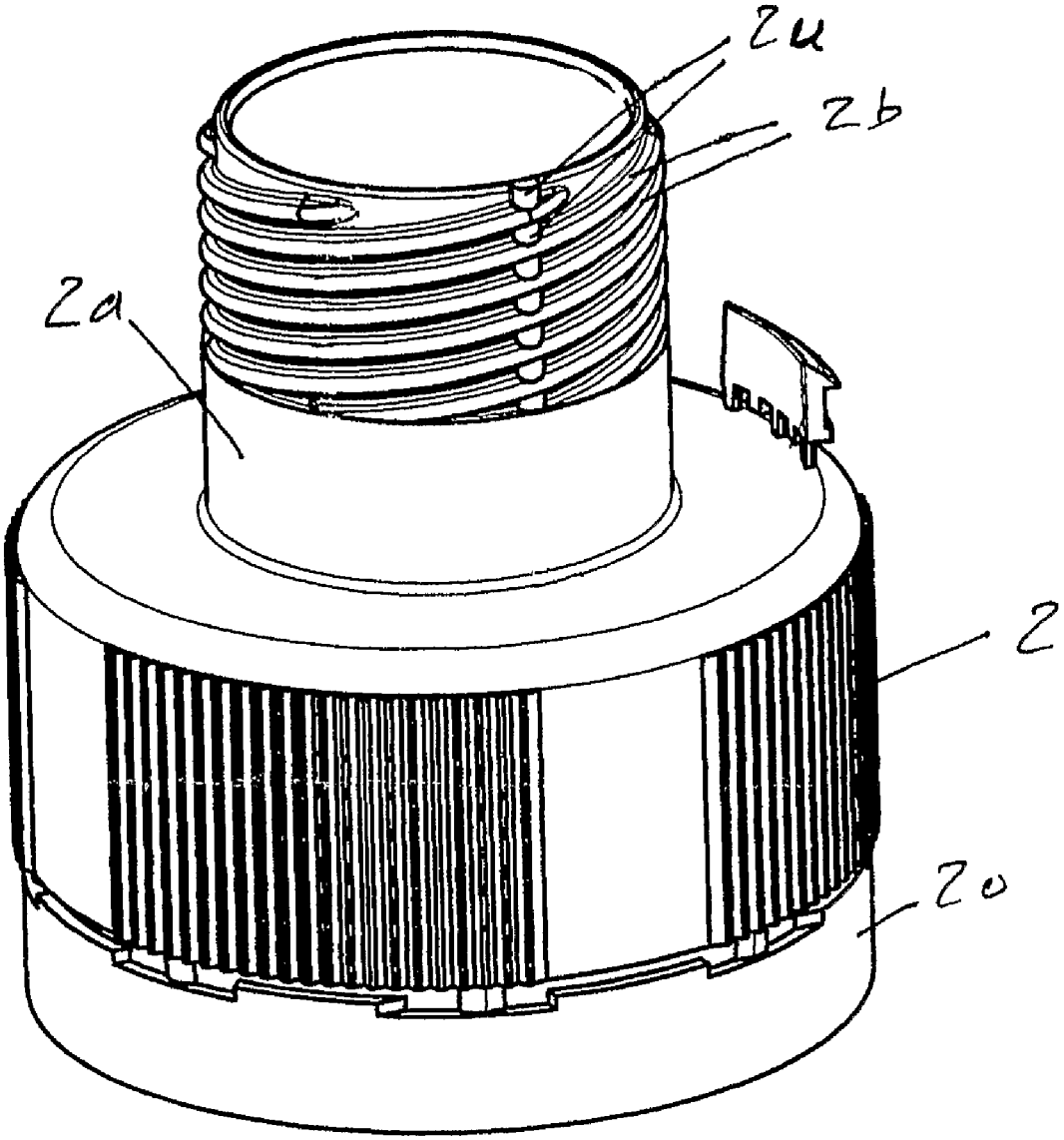
Figure 20:
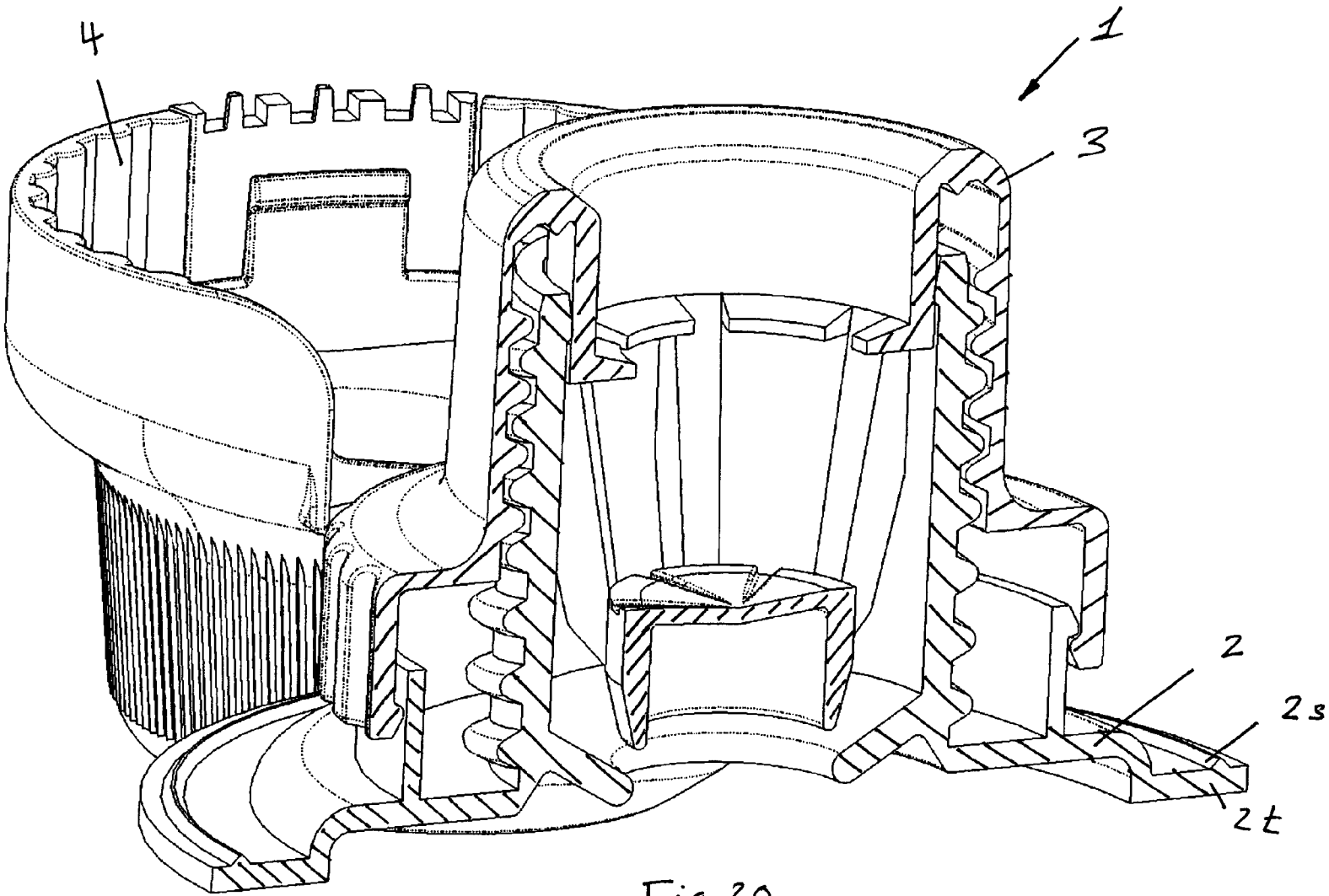

The invention will be described in more detail in the following with reference to embodiments. The Figures show:

FIG. 1 a perspective view of a not yet opened container closure;

FIG. 1*a* a detailed view C of the position of intended fracture;

FIG. 2 a perspective view of the opened container closure, partly in section and partly with an opened protective cover;

FIG. 3 a perspective view of the flange of the container closure which is designed as a screw cap;

FIG. 4 a longitudinal section through the screw cap in accordance with FIG. 3;

FIG. 5 a longitudinal section through the container closure in accordance with FIG. 1;

FIG. 6 a detailed view A of the longitudinal section in accordance with FIG. 5;

FIG. 7 a longitudinal section through an open container closure with the protective cover closed;

FIG. 8 a detailed view B of the longitudinal section in accordance with FIG. 7;

FIG. 9 a perspective view of the same opened container closure shown in FIG. 2 from a different viewing direction;

FIG. 10 a longitudinal section through the container closure in accordance with FIG. 9;

FIG. 11 a plan view on the container closure in accordance with FIG. 9;

FIG. 12 a perspective view of a further embodiment of an opened container closure in section;

FIG. 13 a perspective view of a further embodiment of an opened container closure in section;

FIG. 14 a perspective view of a further not yet opened container closure;

FIG. 15 a further embodiment of a screw cap;

FIG. 16 a further embodiment of a closure;

FIG. 17 the closure shown in FIG. 16 from a different viewing direction;

FIG. 18 a further embodiment of a closure having a protective cover seen from below;

FIG. 19 a further embodiment of a screw cap;

FIG. 20 a further embodiment of a flange.

FIG. 1 shows a container closure 1 in a perspective view. A protective cover 4 is pivotally connected to the rotary closure 3 via a hinge. The container closure 1 includes a flange 2 which is designed as a screw cap. Both the screw cap 2 and also the protective cover 4 have ribbing extending in the peripheral direction. The screw cap 2 includes a guarantee band 2*f* with hook 2*g* which is connected to the screw cap 2 via one or more positions of intended fracture 2*h*. The protective cover 4 includes an opening shield with a holding part 4*c*. The container closure 1 shown in FIG. 1 has never been opened so that the position of intended fracture 2*h* is still intact and the protective cover 4 is firmly held at least via the guarantee band. Further holding means can also be provided. On opening of the container closure 1 the holding part 4*c* can be used as a support for a finger in order to thereby exert a force on the protective cover 4 and to lift the latter.

FIG. 1*a* shows the section C of FIG. 1 in detail. The guarantee band 2*f* is connected via points of intended fracture 2*h* to the screw cap 2 lying beneath it. These points of intended fracture 2*h* are parted during opening of the protective cover 4. Moreover the guarantee band 2*f* has a plurality of supports 2*r* which are slightly spaced relative to the protective cap 2 and thus not connected to it. These supports 2*r* serve to relieve the points of intended fracture 2*h* from pressure. Without these supports 2*r* the points of intended fracture 2*h* could be damaged with a force acting downwardly via the hook 2*g*.

FIG. 2 shows the container closure 1 shown in FIG. 1 in the open state and in a perspective view, partly in section. The container closure 1 includes a screw cap 2 with quality ring 2*o* and inlet opening 2*p* and also an outlet tube 2*a* having an outer thread 2*p* arranged after the inlet opening 2*p* in the outflow direction. The outlet tube 2*a* and the thread 2*b* define an axis of rotation D. The screw cap 2 includes a sealing lip 2*i* projecting towards the axis of rotation D which forms the inlet opening 2*p* extending concentrically to the axis of rotation D. The container closure 1 further includes a rotary closure 3 having an outlet opening 3*p* and an inner thread 3*i*. The two threads 2*b*, 3*i* engage in one another and are aligned such that the rotary closure 3 is rotatable with respect to the screw cap 2 about the axis of rotation D and is displaceably mounted in the direction of the axis of rotation D. The shift in the direction of the rotary axis D brings about a lifting or lowering of the rotary closure 3 relative to the screw cap 2. The rotary closure 3 includes a spigot 3*a* arranged concentric to the axis of rotation D which is arranged after the inlet opening 2*p* in the outflow direction. Through the rotation of the rotary closure 3 the latter, and thus also spigot 3*a* connected to the rotary closure 3, moves in the direction of extent of the axis of rotation D. Through a corresponding turning of the rotary closure 3 the spigot 3*a* is displaceable into at least two different positions, a closing position SS in which the spigot contacts the sealing lip 2*i* so that the inlet opening 2*p* is closed and an open position OS in which the spigot 3*a* is spaced with respect to the sealing lip 2*i* so that the inlet opening 2*p* is opened. The spigot 3*a* has a sealing surface 3*c* which is intended for contact at the sealing lip 2*i*, with the sealing surface 3*c* having an angle of inclination a in the range between 1° and 45° with respect to the direction of extent of the axis of rotation D. The spigot 3*a* preferably has an internal hollow space 3*b* so that the outer walls of the spigot 3*a* extending in a direction of extent of the axis of rotation D are pressed in the radial direction outwardly against the sealing cover 2*i* by the pressure prevailing in the container. The sealing lip 2*i* extends at an obtuse angle to the axis of rotation D, so that a pressure increase in the liquid container results in the sealing lip 2*i* trying to move in the direction of the outflow direction, which additionally increases the sealing function between the spigot 3*a* and the sealing lip 2*i*. This arrangement of the sealing lip 2*i* and also the internal hollow space 3*b* of the spigot 3*a* have the result that the sealing lip 2*i* and the spigot 3*a* are pressed harder against one another with increasing pressure in the container so that the sealing function increases and a reliable sealing function is ensured even at high pressures. The entire rotary closure 3 can be made inelastic. In a preferred embodiment, however at least the portion connecting the spigot 3*a* to the thread 3*i* is made partly elastic in order to ensure a relative movement of the spigot 3*a* with respect to the thread 3*i* in the direction of the axis of rotation D.

The rotary closure 3 shown in FIG. 2 has a mouthpiece 3*h* with a drinking opening 3*p*, with the mouthpiece 3*h* having a U-shaped cross-section in the direction of the axis of rotation D, with a tubular outer part 3*n* having an internal thread 3*i* and with a tubular inner portion 3*g*. The rotary closure 3 is rotatable with respect to the screw cap 2 via the two threads 2*b*, 3*i* and displaceably mounted in the direction of the axis of rotation D. The spigot 3*a* is connected via an elastic portion 3*d* to the tubular inner portion 3*g*, with the elastic portion 3*d* in this embodiment being formed as a plurality of webs 3*d* arranged distributed in the peripheral direction. A passage opening 3*e* is respectively arranged between the webs 3*d*. The rotary closure 3 can now be displaced with respect to the screw cap 2 by a corresponding rotation about the axis of rotation D so that the spigot 3*a* can either be moved towards the inlet opening 2*p* in order to close the inlet opening 2*p* or can be moved in the opposite direction, away from the inlet opening 2*p*, in order to open the inlet opening 2*p*. The fluid flowing out of the container into the inlet opening 2*p* flows via the passage openings 3*e* to the outlet opening 3*p*. The rotary closure 3 has an actuating element 3*k* with drive cams arranged after the cylindrical outer portion 3*n* and/or a ribbing which is preferably held by the fingers so that a pleasant rotation of the rotary closure 3 is possible. The container closure 1 is however preferably actuated in such a way that the rotary closure 3 screw cap with closed protective cover 4 is turned.

In a preferred embodiment the flange 2 includes a cover wall 2*d* with abutment 2*e* and the rotary closure 3 likewise includes an abutment 3*l*, in order to restrict the maximum stroke of the rotary closure 3 in the direction of the axis of rotation D.

In a further advantageous embodiment the rotary closure 3 has a plurality of noses 3*f* projecting in the direction of the axis of rotation D. As is shown in FIG. 11 in a plan view of the rotary closure 3 the projecting noses 3*f*, the webs 3*d* and also the spigots 3*a* are arranged such that these cover the entire outlet opening area 3*p*. This design has the advantage that a liquid jet shooting into the inlet opening 2*p* cannot move in a straight line in the direction of the rotary axis D but is rather broken at the elements 3*a*, 3*d*, 3*f* which makes it impossible for a liquid jet to shoot directly out of the inlet opening 2*p*. A liquid jet is thus always broken before it emerges from the outlet opening 3*p* which enables a pleasant opening of the container closure 1.

In a preferred embodiment, a container closure 1 includes, as shown in FIG. 2, a protective cover 4 which is connected to the rotary closure 3 via a non-illustrated hinge. The protective cover 4 includes at the inner side drive cams 4*a* arranged spaced apart in the peripheral direction which, in the closed state of the container closure 1 shown in FIG. 1, engage into the drive cams 3*k* of the rotary closure 3 so that a torque exerted in FIG. 1 onto the protective cover 4 is transmitted to the rotary closure 3. This enables a force to act on the guarantee band 2*f* which is large enough to break the position of intended fracture 2*h*. The position of intended fracture 2*h* can, however, for example, also be broken in that a force acting upwardly in the direction of the rotary axis D is exerted onto the opening shield with the holding part 4*c* until the point of intended fracture 2*h* breaks and the protective cover 4 can thereby be pivoted.

The driving cams 3*k*, 4*a* moreover ensure that no excessive forces act at the hinge 4*d*. As shown in FIG. 2 the guarantee band 2*f* remains on the protective cover 4. As can be seen from FIG. 2 the protective cover moreover includes a hook part 4*b*.

In a preferred embodiment the rotary closure 3 has an elastic portion 3*d* between the spigot 3*a* and the thread 3*i* which can be compressed at least in the direction of the axis of rotation D so that the spigot 3*a* can be displaced in the direction of the axis of rotation D and relative to the thread 3*i* when a force directed in the direction of the axis of rotation D towards the outlet opening 3*p* acts at the spigot 3*a*. The webs 3*d* shown in FIG. 2 thus have elastic characteristics in an advantageous embodiment. The elastic characteristics can be matched to the forces which are to be expected which are caused by the pressure in the container and act on the spigot 3*a*. For example the webs 3*d* could have a low elastic property in the direction of the axis of rotation D with a drink containing a lot of carbon dioxide, in order to ensure that the spigot 3*a* is not unintentionally lifted so strongly that the inlet opening 2*p* is opened.

The guarantee band 2*f* is advantageously also connected in the open state to the protective cover 4 so that on opening the container closure 1 no disposable part arises.

FIG. 5 shows a longitudinal section of a closed container closure 1. If the pressure in the container exceeds a certain value then the spigot 3*a* is shifted upwardly as a result of the elastic characteristics of the webs 3*d* sufficiently far that the inlet opening 2*p* is opened and fluid can escape so that the pressure in the container is reduced. As a result of the elastic characteristics the inlet opening 2*p* is automatically closed again after the pressure dissipation by the spigot 3*a*. Thus it is ensured that a pressure dissipation takes place as soon as the pressure in the container exceeds a predetermined value. Through a corresponding choice of the elastic characteristics of the rotary closure 3, for example via the material or wall thickness, it can thus be previously determined at which pressure the inlet opening 2*p* is opened for the pressure dissipation.

FIG. 3 shows in a perspective view a flange 2 having a hollow cylindrical outlet tube 2*a* and an outer thread 2*b* as well as a seal 2*c* extending in the peripheral direction at the outlet. The flange 2 further includes a cover wall 2*d* having an abutment 2*e*. Moreover the flange 2 includes a guarantee band 2*f* with a hook 2*g* and a point of intended fracture 2*h*. In addition the flange designed as a screw cap 2 includes a quality ring 2*o*.

FIG. 4 shows a longitudinal section through the screw cap 2 shown in FIG. 3. In addition to the elements already described in FIG. 3 the base wall 2*q* of the screw cap 2 can be seen in FIG. 4. The screw cap 2 moreover includes a sealing ring 2*l* extending in the peripheral direction and also an end face sealing lip 2*m* extending in the peripheral direction and a sealing and/or breaking part 2*n* extending in the peripheral direction which is intended to avoid a relative movement between the bottle opening and the screw cap 2.

FIG. 5 shows a container closure 1 in a longitudinal section, with the rotary closure 3 being fully covered by the protective cover 4. The protective cover 4 is connected via the hinge 4*d* to the rotary closure 3. As can be seen from the section drawing the closure 3 is fully arranged within the protective cover 4 so that it is ensured that the rotary closure 3 and in particular the mouthpiece 3*h* is kept hygienically clean.

FIG. 6 shows the section designated with A in FIG. 5 in an enlarged representation. The container closure 1 shown in FIG. 6 has never been opened so that the protective cover 4 is firmly held via the hook 2*g*, the guarantee band 2*f*, the point of intended fraction 2*h* and the holding part 4*c*. In the illustrated embodiment the protective cover 4 is additionally held by the hook part 4*b* and the abutment 2*e*.

If the rotary closure 3 is now turned about the axis of rotation D then the rotary closure 3 moves, as shown in a longitudinal section in FIG. 7, upwardly in the direction of the axis of rotation D and the inlet opening 2*p* is freed by the spigot 3*a* so that the liquid can emerge.

FIG. 8 shows the section designated with B in FIG. 7 in an enlarged representation. It is evident from FIG. 8 that the point of intended fracture 2*h* has been parted and that the hook part 4*b* at the protective cover is no longer latched at the abutment 2*e* so that the protective cover 4 can be swung around the hinge 4*d* so that the rotary closure 3 and the mouthpiece 3*h* are freed. As soon as drinking has been completed the rotary closure 3 can be closed again, either in that a torque is directly exerted on the rotary closure 3 and this is thereby turned about the axis of rotation D and the spigot 3*a* is displaced in the direction of the axis of rotation D. The possibility also exists that the protective cover 4 is first closed and that thereafter a torque acts on the protective cover 4 which transmits torque to the rotary closure 3 so that this is rotated about the axis of rotation D and the spigot 3*a* is thereby moved again into the inlet opening 2*p*. The hook part 4*b* of the protective cover 4 thereby approaches the abutment 2*e* and engages, as soon as the rotary closure 3 has been moved downwardly sufficiently at the abutment 2*e* so that the protective cover 4 is held in its position by the hook part 4*b* in the abutment 2*e*. This signifies that after the opening and closing of the container closure 1 the protective cover 4 is held in a position shown in FIGS. 5 and 6 and the rotary closure 3 and the mouthpiece 3*k* are covered by the protective cover 4 and are thus protected. This arrangement moreover has the advantage that the protective cover 4 is only closed and engaged with the hook part 4*b* if the inlet opening 2*p* is fully closed by the spigot 3*a*. If the protective cover 4 were to be latched when the inlet opening 2*p* is not fully closed then the danger would exist that a pressure dissipation could take place in the space beneath the protective cover 4 and thereby allow the protective cover 4 to open suddenly and escape upwardly in uncontrolled manner. The hook part 4*b* and the abutment 2*e* are thus arranged such that a latching is only possible when the rotary closure 3 is fully closed. A user assumes when the protective cover 4 is closed that the container closure 1 is also closed. Through the previously described measure it is ensured that the protective cover 4 is only fixed or latched in position when the container closure 1 is located in the closed position SS in which the spigot 3*a* contacts the sealing lip 2*i*. It is up to a customer whether he opens or closes the container closure 1 by rotation at the rotary closure 3 of the screw cap 2 or at the protective cover 4. The protective cover 4 and the hook part 4*b* in any event first latches at the abutment 2*e* when the container closure 1 is located in its closed position SS. The container closure 1 in accordance with the invention is extremely hygienic, because the mouthpiece 3*h* is always covered other than during drinking and is thus secured against contamination. The container closure 1 in accordance with the invention thus has excellent hygienic properties and is in particular also suitable for use in a mucky environment.

FIG. 9 shows the container closure 1 in accordance with the invention in the open position and in a perspective view. The rotary closure 3 is rotatably connected to the screw cap 2 and includes a mouthpiece 3*h* and also the drive cams 3*k*. The protective cover 4 is pivotally connected to the rotary closure 3 via the hinge 4*d*. The drive cams 4*a* of the protective cover 4 are arranged such that they can engage in the drive cams 3*k*. The drive cams 4*a* and also the drive cams 3*k* can be designed and mutually matched such that they form a latch device in order to hold the protective cover 4 in a closed position. The mouthpiece 3*h* is shown elliptically or ovally in the embodiment shown in FIG. 9 which enables very pleasant drinking.

FIG. 10 shows a longitudinal section of the container closure 1 shown in FIG. 9.

FIG. 11 shows a plan view of the container closure 1 shown in FIGS. 9 and 10. The protective cover 4 includes a circular sealing lip 4*e* which can contact the mouthpiece 4*h*. Radially outwardly extending reverse flow grooves 3*m* are arranged in the surface of the spigot 3*a* which form a groove which becomes progressively deeper towards the outside in order to thereby bring about a gradient towards the outside when the closure 1 is standing upright. If the drinking is finished and the bottle is subsequently held approximately vertically then the liquid present in the rotary closure 3 flows via the inlet opening 2*p* back into the bottle arranged beneath it. The return flow grooves 3*m* ensure that the liquid which is present on the surface of the spigot 3*a* also flows back into the inlet opening 2*p*.

FIG. 12 shows in a longitudinal section a further embodiment of a container closure 1 with screw cap 3 and rotary closure 3. In distinction to the embodiment shown in FIG. 2 the container closure 1 in accordance with FIG. 12 has no protective cover 4. The mouthpiece 3*h* could for example be covered with a foil which can be pulled off in order to protect the mouthpiece 3*h* from contamination. The embodiment shown in FIG. 12 also distinguished from the container closure 1 shown in FIG. 2 in that the outlet tube 2*a* has an internal thread 2*b* and the tubular inner portion 3*g* has an outer thread 3*i*, with these threads 2*b*, 3*i* defining the axis of rotation D and causing the stroke movement in the direction of extent of the axis of rotation D.

FIG. 13 shows a further embodiment of a container closure 1 with the rotary closure 3 not having any webs 3*d* in distinction to the embodiment shown in FIG. 2 and with the spigot 3*a* being directly connected to the noses 3*f* and with openings 3*q* arranged distributed between the noses 3*f* and the peripheral direction resulting through which the liquid can emerge. Moreover an elastic portion 3*t* could be arranged between the spigot 3*a* and the noses 3*f* in order to enable a relative movement of the spigot 3*a* with respect to the noses 3*f*. The noses 3*f* could also be of elastic design in order to enable a relative movement of the spigot 3*a* with respect to the outlet opening 3*p*.

The pitch of the threads 2*b*, 3*i* determines the stroke per turn of the rotary closure 3 brought about in the direction of extent of the axis of rotation D. Depending on the requirement placed on the container closure 1, for example the maximum applied pressure, a thread 2*b*, 3*i* can b selected with a correspondingly matched pitch. If the pressure in the container is very high, then a thread 2*b*, 3*i* with a small pitch is advantageously selected so that the container closure 1 can for example first be opened after 3 to 5 turns. On the other hand, a thread 2*b*, 3*i* of this kind can for example be selected so that the container closure already opens fully with a rotation through of 180 degrees. The thread 2*b*, 3*i* can thus be designed as a multistart thread, for example as a four start thread.

In the embodiment of a container closure 1 shown in FIG. 14, in distinction to the embodiment of FIG. 1, the opening shield 4*i* intended for the opening is arranged separately from the holding part 4*c* which serves for the holding of the guarantee band 2*f*. A plurality of holding parts 4*c* each having a guarantee band 2*f* could also be provided in the peripheral direction of the protective cover 4.

FIG. 15 shows a screw cap 2 such as is used in the container closure 1 in accordance with FIG. 14. At the left the guarantee band 2*f* with the point of intended fraction 2*h* and the hook 2*g* can be seen. At the right of it the abutment 2*e* is provided which serves for the engagement of the hook part 4*b*.

FIG. 16 shows the container closure 1 shown in FIG. 14 in the open position, partly in section. The important differences relative to the container closure 1 described in FIG. 2 are that no cover wall 2*d* is present but only the relatively narrow part with the abutment 2*e*, which serves for the latching in place of the hook part 4*b*, as shown in FIG. 15. The further important distinction is that the guarantee band 2*f* is held at the side and in this way no guarantee band 2*f* is located at the hook part 4*b*. The hook part 4*b* is held by the abutment 2*e* when the protective cover 4 is closed. In distinction to the embodiment of FIG. 2 the webs 3*d* and the passage openings 3*e* are made broader in the peripheral direction in FIG. 16 and fewer webs 3*d* are used. Moreover, no seal 2*c* is used, instead the rotary closure 3 has a projecting seal 3*r* extending over the entire periphery which contacts the outlet tube 2*a*.

FIG. 17 shows the container closure 1 shown in FIG. 16 from a different viewing angle. Particular significance is attributed to the vent hole 3*q* which opens to the surface in the region of the mouthpiece 3*h*. The vent hole 3*q* represents a fluid conducting connection to the outer space, with the outer space meaning the space outside of the container and also the space outside of the outlet tube 2*a*. In FIG. 16 an embodiment of the vent hole 3*q* is shown. This vent hole 3*q* opens into the intermediate space between the hollow cylindrical outer portion 3*n* and the hollow cylindrical inner portion 3*g*. This intermediate space is fluid-conductingly connected to the outer space via the thread 2*b*, 3*i*. During the drinking the mouthpiece 3*h* is preferably fully surrounded by the mouth of the person drinking, i.e. by their lips, with the vent hole 3*q* being arranged such that this opens into the mouth. During drinking air from the outer space is thus supplied to the open mouth, with the air thereafter flowing via the container closure 1 that is to say the outlet opening 3*p* and subsequently the inlet opening 2*p* into the inner space of the container connected with the screw cap 2. In an advantageous embodiment it is ensured in this way that additional air is supplied to the container during drinking, so that for example a continuous drinking or a continuous removal of liquid from the container is possible.

FIG. 18 shows an embodiment of a rotary closure 3 the inner thread 3*i* of which is arranged as illustrated in grouped manner. In the illustrated embodiment the internal thread 3*i* is subdivided in the peripheral direction into separate groups. This results in a weight advantage. The inner thread 3*i* is interrupted or relieved in order to restrict the rotary movement and the stroke. This can be understood from the view of a screw cap 2 shown in FIG. 19. This screw cap 2 has an outlet tube 2*a* with an outer thread 2*b* with a projecting path limiting cam 2*u* being disposed at the outer thread 2*b*. The inner thread 3*i* abuts after a specific rotary movement about the axis D against this path restricting cam 2*u* so that this restricts the rotary movement of the rotary closure 3 and thus also the maximum possible stroke movement of the rotary closure, so that the inner thread 3*i* and the path restricting cam 2*u* cooperate in such a way that they form a stroke restricting means.

The mouthpiece 3*h* is preferably designed elliptically or ovally extending, whereas the outer part 3*n* is preferably of hollow cylindrical shape as shown in FIG. 18. Thus the rotary closure 3 has hollow spaces 3*s* which extend in the direction of extent of the axis of rotation D, so that the rotary closure 3 has an elliptically extending outer contour. The hollow spaces 3*s* could also be filled with material. The vent hole 3*q* could be fluid-conductingly connected to the hollow space 3*s* so that the air supply for the vent hole 3*q* takes place via the hollow space 3*s*.

The embodiments shown in the Figures are exemplary embodiments. The container closure 1 having the features in accordance with the invention can be designed in a plurality of further embodiments, for example in that the internal diameter of the outlet tube 2*a* is selected to be larger than the total height of the outlet tube 2*a* or in that the webs 3*d* can be made very short so that the container closure 1 has a small overall height. The embodiments shown in the Figures can also be interchanged among one another, for example in that the rotary closure 3 of the container closures 1 shown in FIGS. 12 and 13 can be swapped. For example the number of the webs 3*d* arranged in the peripheral direction could be varied so that the container closure 1 for example has two, three, four or six webs 3*d*. For example the stroke restriction in the embodiment in accordance with FIG. 15 could also take place by a peripherally extending abutment 2*e*.

With liquids tending towards foaming, such as for example Coca Cola, it is of advantage that the pressure can be rapidly dissipated during the opening of the rotary closure 1. This can for example be achieved in that the rotary closure 1 is designed such that the maximum stroke is already achieved with a small rotary movement of for example 90 degrees which enables a very rapid opening of the container closure.

FIG. 20 shows a perspective view of a further opened container closure 1 in which, in distinction to the embodiment shown in FIG. 2, the flange 2 includes a peripherally extending plate 2*t* with energy direction giver 2*s* which serves to weld the flange 2 from the inside to a packing material. A packing material can for example consist of card-board, cardboard composite or plastic and form a container. The flange 2 could also have a peripherally extending plate 2*t* designed in such a way that it can be adhesively bonded from the outside onto a container. This plate 2*t* can for example be designed as a weld flange or as an adhesive bonding flange.

The invention claimed is:

1. A container closure (1), comprising a flange (2) having an inlet opening (2*p*) and an outlet tube (2*a*) having a first thread (2*b*) disposed after the inlet opening (2*p*) in outflow direction and further comprising a rotary closure (3) with an outlet opening (3*p*) and with a second thread (3*i*), wherein the first and second threads (2*b*, 3*i*) engage with one another, have a pitch, and are configured such that the rotary closure (3) is rotatable with respect to the flange (2) about an axis of rotation (D) and is further displaceably mounted in the direction of the rotary axis (D), wherein the flange (2) includes a sealing lip (2*i*) projecting towards the axis of rotation (D) which forms the inlet opening (2*p*) extending concentric to the axis of rotation (D), wherein the rotary closure (3) has a spigot (3*a*) disposed concentric to the axis of rotation (D) which is arranged in the outflow direction after the inlet opening (2*p*) and wherein the spigot (3*a*) and the sealing lip (2*i*) are configured to allow displacement of the spigot (3*a*) in the direction of the axis of rotation (D) to so allow the spigot to adopt at least two positions, a closed position (SS) in which the spigot (3*a*) contacts the sealing lip (2*i*) so that the inlet opening (2*p*) is closed, and an open position (OS), in which the spigot (3*a*) is spaced from the sealing lip (2*i*) so that the inlet opening (2*p*) is opened, and wherein the rotary closure (3) has an elastic portion that is positioned between the spigot (3*a*) and the thread (3*i*) so that the spigot (3*a*) is displaceably or resiliently mounted in the direction of the axis of rotation (D) relative to the thread (3*i*), and wherein the container closure is further configured to automatically open upon a predetermined excessive pressure to thereby relieve the excessive pressure.

2. Container closure in accordance with claim 1, characterized in that the rotary closure (3) includes a tubular inner portion (3*g*) which is displaceably arranged within the outlet tube (2*a*) in the direction of the axis of rotation (D) and in that the tubular inner portion (3*g*) forms the outlet opening (3*p*).

3. Container closure in accordance with claim 2, characterized in that a seal (2*c*) extending in the peripheral direction is arranged between the outlet tube (2*a*) and the tubular inlet portion (3*g*).

4. Container closure in accordance with claim 2, characterized in that the tubular inner portion (3*g*) has noses (3*f*) projecting in the direction towards the axis of rotation (D).

5. Container closure in accordance with claim 4, characterized in that the projecting noses (3*f*), the elastic portion (3*d*) and the spigot (3*a*) are dimensioned such that the projecting noses (3*f*), the elastic portion (3*d*) and the spigot (3*a*), when viewed in the direction of the axis of rotation (D) from the outlet opening (3*p*), cover the entire surface of the outlet opening (3*p*).

6. Container closure in accordance with claim 1, characterized in that the elastic portion (3*d*) comprises a plurality of webs (3*d*) arranged spaced apart in the peripheral direction relative to the axis of rotation (D), which connect the tubular inner portion (3*g*) to the spigot (3*a*), with a passage opening (3*e*) resulting between adjacent webs (3*d*).

7. Container closure in accordance with claim 1, characterized in that the rotary closure (3) has an at least anatomically shaped mouthpiece (3*h*) in the region of the outlet opening (3*p*).

8. Container closure in accordance with claim 7, characterized in that the mouthpiece (3*h*) has an oval extending shape with respect to the axis of the rotation (D).

9. Container closure in accordance with claim 1, characterized in that the first and second threads are (2*b*, 3*i*) formed as a multi-start thread.

10. Container closure in accordance with claim 1, characterized in that the flange (2) and the rotary closure (3) have a stroke restriction element (2*e*, 3*l*; 2*u*, 3*i*) that is configured to restrict the displacement of the rotary closure (3) with respect to the flange (2).

11. Container closure in accordance with claim 1, further including a protective cover (4) which is configured to cover the mouthpiece (3*h*).

12. Container closure in accordance with claim 11, characterized in that the protective cover (4) is pivotally connected to the rotary closure (3).

13. Container closure in accordance with claim 11, characterized in that the protective cover (4) is configured to cover the entire rotary closure (3).

14. Container closure in accordance with claim 11, characterized in that the rotary closure (3) has projecting first drive cams (3*k*) at an outer surface, in that the protective cover (4) has projecting second drive cams (4*a*) and an inner surface, and in that the first and second drive cams (3*k*, 4*a*) are configured such as to allow inter-engagement when the protective cover (4) is closed to thereby allow transmission of a torque acting on the protective cover (4) to the closure (3).

15. Container closure in accordance with claim 11, characterized in that the flange (2) includes a guarantee closure (20 with a point of intended fracture (2*h*) which is configured such that the guarantee closure (2*f*) holds the protective cover (4) in the closed position so long as the point of intended fracture (2*h*) has not been broken.

16. Container closure in accordance with claim 11, characterized in that the protective cover (4) includes a latching device (4*b*) that is configured to allow latching on at least one of the flange (2) and the rotary closure (3) to thereby hold the protective cover (4) in a closed position.

17. Container closure in accordance with claim 16, characterized in that the flange (2) has an abutment (2*e*) in which the latch device (4*b*) of the protective cover (4) can latch, with the abutment (2*e*) and the latch device (4*b*) being dimensioned in the direction of extent of the axis of rotation (D) such that the flange (2) and the protective cover (4) can only mutually latch in the closed position (GS).

18. Container closure in accordance with claim 1, characterized in that the outlet tube (2*a*) has an first thread (2*b*); in that the mouthpiece (3*h*) has a U-shaped cross-section in the direction of the axis of rotation (D) having a tubular outer part (3*n*) with an second thread (3*i*) and with the tubular inner portion (3*g*), so that the outlet tube (2*a*) is disposed between the tubular outer part (3*n*) and the tubular inner portion (3*g*).

19. Container closure in accordance with claim 1, characterized in that the sealing lip (2*i*) extends at an obtuse angle with respect to the axis of rotation (D) in the direction away from the outlet opening (3*p*).

20. Container closure in accordance with claim 1, characterized in that the spigot (3*a*) has an internal hollow space (3*b*).

21. Container closure in accordance with claim 1, characterized in that at least one of the sealing lip (2*i*) and the spigot (3*a*) has sufficient elasticity to increase contact pressure when a higher pressure is applied in the inner space of the container.

22. Container closure in accordance with claim 1, characterized in that a guarantee closure (2*f*) is coupled to the protective cover (4) in the open state so that on opening the container closure no disposable part arises.

23. Container closure in accordance with claim 1, characterized in that a vent hole (3*q*) opens from a position outside the container closure towards the mouthpiece (3*h*).

24. A container comprising a container closure in accordance with claim 1, wherein the container contains a liquid containing carbon dioxide or a liquid prone to gassing.

25. Container closure in accordance with claim 1, characterized in that the elastic portion comprises a plurality of webs (3*d*), and wherein the webs (3*d*) are elastically formed.

26. Container closure in accordance with claim 25, characterized in that the spigot (3*a*) has a sealing surface (3*c*) which is configured to allow contacting the sealing lip (2*i*) and further characterized in that the sealing surface (3*c*) has an angle of inclination a with respect to the direction of extent of the axis of rotation (D) in the range between 1° and 45°.

* * * * *